US006501235B2

(12) United States Patent
Ortmeyer

(10) Patent No.: US 6,501,235 B2
(45) Date of Patent: Dec. 31, 2002

(54) MICROCONTROLLED BALLAST COMPATIBLE WITH DIFFERENT TYPES OF GAS DISCHARGE LAMPS AND ASSOCIATED METHODS

(75) Inventor: Clifford J. Ortmeyer, McHenry, IL (US)

(73) Assignee: STMicroelectronics Inc., Carrollton, TX (US)

( * ) Notice: Subject to any disclaimer, the term of this patent is extended or adjusted under 35 U.S.C. 154(b) by 0 days.

(21) Appl. No.: 09/794,306

(22) Filed: Feb. 27, 2001

(65) Prior Publication Data

US 2002/0117976 A1 Aug. 29, 2002

(51) Int. Cl.[7] ..... H05B 37/02
(52) U.S. Cl. ..... 315/307; 315/105; 315/308
(58) Field of Search ..... 315/105, 106, 315/107, 307, 308

(56) References Cited

U.S. PATENT DOCUMENTS 5,969,483 A 10/1999 Li et al. ..... 315/225
6,300,719 B1 * 10/2001 Tlaga et al. ..... 315/94

* cited by examiner

*Primary Examiner*—David Vu
(74) *Attorney, Agent, or Firm*—Lisa K. Jorgenson; Christopher F. Regan

(57) ABSTRACT

A ballast compatible with different types of gas discharge lamps includes a power supply and a controller connected to the power supply. The controller includes a memory having a plurality of desired operating parameters stored therein for respective different types of gas discharge lamps. A sensing circuit causes the power supply to supply a current to the gas discharge lamp prior to start-up and senses a voltage based thereon indicative of a type of the gas discharge lamp. A control circuit causes the power supply to provide the desired operating parameters based upon the type of gas discharge lamp. Since the desired operating parameters are applied to the gas discharge lamp, the life of the lamp is increased.

43 Claims, 4 Drawing Sheets

MICROCONTROLLED BALLAST COMPATIBLE WITH DIFFERENT TYPES OF GAS DISCHARGE LAMPS AND ASSOCIATED METHODS

FIELD OF THE INVENTION

The present invention relates to the field of lighting devices, and more particularly, to a ballast for a gas discharge lamp.

BACKGROUND OF THE INVENTION

Gas discharge lamps are widely used for general illumination and offer substantial advantages such as efficiency, color, coolness and shape over incandescent lamps. Gas discharge lamps include fluorescent lamps and high-intensity discharge (HID) lamps. These lamps are driven with a ballast. The ballast provides a predetermined level of current to the lamp which causes the lamp to emit light. To initiate current flow through a gas discharge lamp, the ballast provides a relatively high start-up voltage. After the gas discharge lamp has been ignited, a lower operating voltage is applied.

A conventional ballast generally provides predetermined operating parameters for characteristics adapted for a single lamp type. Operating parameters include a start-up voltage, a preheat time with a preheat frequency or pulse width which sets a preheat current, an operating frequency and a frequency ramping profile. The frequency ramping profile shifts the operating frequency from preheat to ignition, and then to operating. For example, a 40 watt gas discharge lamp may require a start-up voltage of 800 volts, whereas the start-up voltage for a 40 watt gas discharge lamp will be different.

However, gas discharge lamps of different wattages generally have different operating parameters. For example, the operating parameters for a 20 watt gas discharge lamp are different than those for the 40 watt gas discharge lamp. Consequently, the gas discharge lamp is generally ignited with a high enough start-up voltage that will support the desired lamp type and other lamp types having a start-up voltage less than the desired lamp type. The other operating parameters supporting the desired lamp type will also generally support these other lamp types requiring a lower startup voltage.

An advantage of this approach is in terms of manufacturing cost since a single ballast can be used instead of providing multiple versions of gas discharge lighting devices, each with a uniquely configured ballast. However, to support these different lamp types, the same high start-up voltage is applied to all gas discharge lamps even if a lower start-up voltage is better suited.

An excess voltage applied to a gas discharge lamp may decrease the life of the lamp. This difference in usable lamp life may be especially important in applications where the gas discharge lamp is turned on and off on a regular basis, such as in storage areas and spaces with occupancy sensors.

SUMMARY OF THE INVENTION

In view of the foregoing background, it is an object of the present invention to provide a ballast and associated method that is compatible with different types of gas discharge lamps.

This and other objects, features and advantages in accordance with the present invention are provided by a ballast comprising a power supply, and a controller connected to the power supply. The controller preferably comprises a memory having a plurality of desired operating parameters stored therein for respective different types of gas discharge lamps, and a sensing circuit for causing the power supply to supply a current to the gas discharge lamp prior to start-up and sensing a voltage based thereon indicative of a type of the gas discharge lamp.

The ballast preferably further comprises a control circuit for causing the power supply to provide the desired operating parameters based upon the type of gas discharge lamp. Since the desired operating parameters are applied to the gas discharge lamp, the life of the lamp is increased. The ballast according to the present invention is thus compatible with different types of gas discharge lamps, such as lamps of different wattages.

The desired operating parameters may include at least one of a start-up voltage, preheat time and a preheat frequency, an operating frequency, a frequency ramping profile which shifts the operating frequency from preheat to ignition to operation, fault detection levels, and minimum and maximum dimming frequency to be used with an external dimming control.

The gas discharge lamp preferably comprises a housing, at least one electrode carried by the housing, and a gas contained within the housing and contacting the at least one electrode. In one embodiment of the present invention, the sensing circuit senses the voltage across one of the electrodes.

The sensing circuit may include a switching circuit connected to a first voltage reference and to the electrode. The control circuit, which may include a microcontroller, provides a control signal for operating the switching circuit so that the current is supplied to the electrode. In one embodiment of the present invention, the switching circuit comprises at least one photocoupler. The sensing circuit may further include a sense resistor connected between the electrode and a second voltage reference.

The sensed voltage may be either across the electrode alone or across the electrode and the sense resistor. The sensed voltage is converted to a digital value by an analog to digital converter, which may be internal to the microcontroller, for example. The sensing circuit senses the voltage prior to every start-up. The sensed voltage is compared to a database of lamp type voltages stored within the memory. If the sensed voltage is within a particular range, then the control circuit causes the power supply to provide the desired operating parameters based upon the voltages corresponding to the stored lamp type voltage.

In yet another embodiment of the ballast according to the present invention, the controller preferably comprises a fault detection circuit connected between the gas discharge lamp and the control circuit. A fault counter within the control circuit counts the number of times the ballast has had a fault or has failed to ignite. This information may then be used to modify the start-up characteristics of the ballast prior to attempting to restart the ballast again. In addition, fault information may be transferred to a master controller or computer external the gas discharge lighting device.

Another aspect of the invention relates to a method for operating a ballast compatible with different types of gas discharge lamps. The method preferably comprises storing a plurality of desired operating parameters for respective different types of gas discharge lamps. A current is supplied to the gas discharge lamp via a power supply prior to start-up and a voltage based thereon indicative of a type of the gas discharge lamp is sensed. The method preferably further includes controlling the power supply to provide the desired operating parameters based upon the type of gas discharge lamp.

The controlling preferably comprises comparing the sensed voltage to a plurality of lamp type voltages corresponding to respective different types of gas discharge lamps, and selecting the desired operating parameters based upon the sensed voltage corresponding to a stored lamp type voltage. The gas discharge lamp comprises at least one electrode, and the sensing comprises sensing the voltage across the at least one electrode.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. The dimensions of layers and regions may be exaggerated in the figures for greater clarity.

Figure 1:
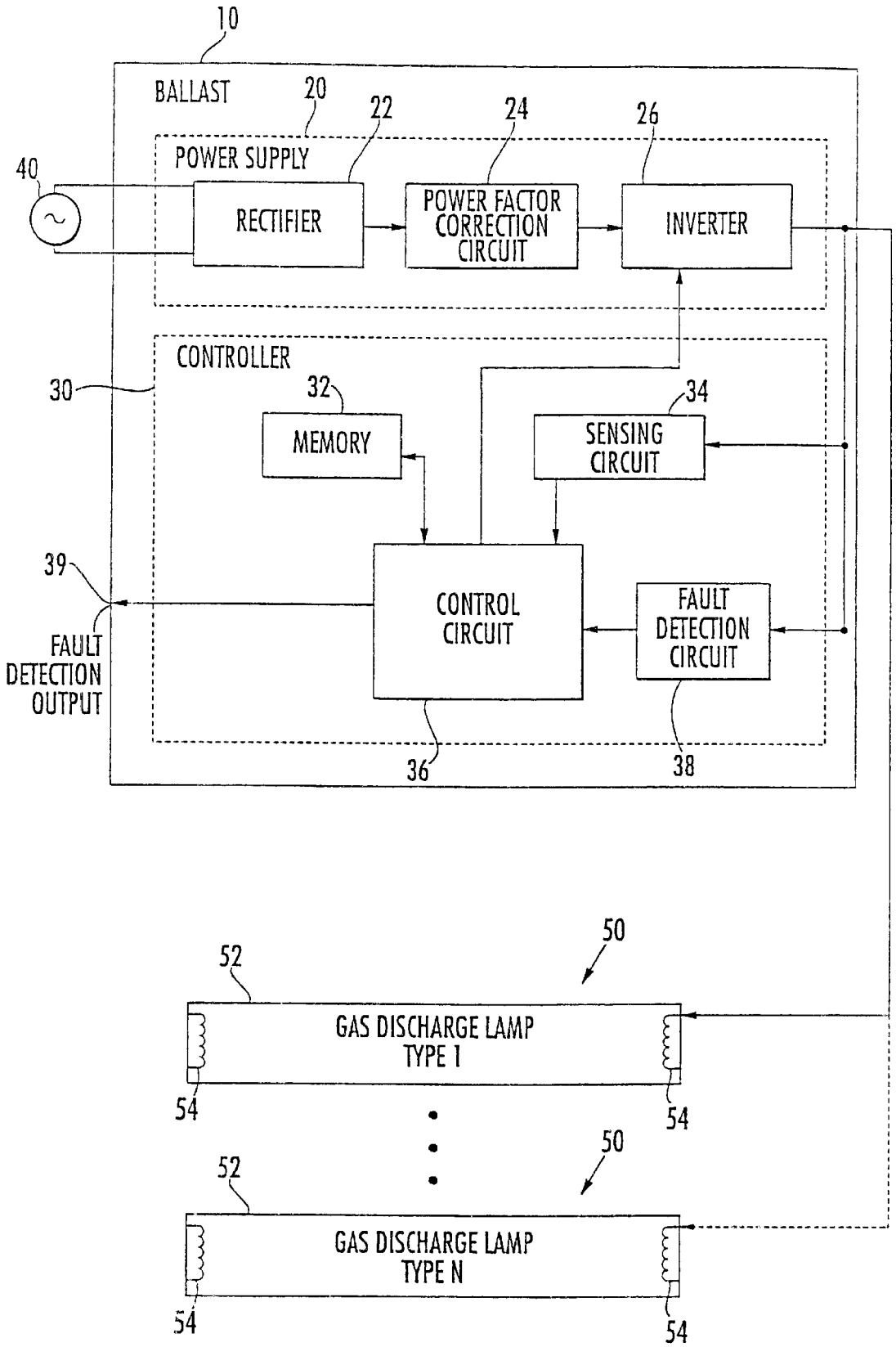
FIG. 1 is a block diagram of a ballast in accordance with the present invention.

Referring initially to FIG. 1, a ballast 10 compatible with different types of gas discharge lamps 50 in accordance with the present invention will now be described. The ballast 10 comprises a power supply 20 and a controller 30 connected thereto. The ballast 10 is connected to an alternating current (AC) source 40 providing an alternating line voltage and current. At least one gas discharge lamp 50 is connected in series with the ballast 10.

The gas discharge lamp 50 may be a fluorescent lamp or a high-intensity discharge (HID) lamp. These different types of gas discharge lamps 50 are represented by type 1 through type n in FIG. 1. The different types of gas discharge lamps may represent lamps of different wattages, for example. Each type of gas discharge lamp 50 is formed generally of an evacuated translucent housing 52 which has two electrodes or filaments 54 located at opposite ends of the housing. On compact fluorescent lamps, the electrodes 54 are generally next to each other. A small amount of mercury is generally contained within the evacuated housing 52.

When the gas discharge lamp 50 is lighted, the mercury is vaporized and ionized into a conductive medium, and current is conducted between the electrodes 54 through the mercury medium creating a plasma. The light energy from the plasma creates the illumination. Due to the conductivity characteristics of the plasma medium, the ballast 10 limits the current flow through the plasma to prevent the electrodes 54 from burning out.

The power supply 20 includes a rectifier 22, a power factor correction circuit 24 and an inverter 26. The rectifier 22 includes an input connected to the AC source 40 for receiving the alternating line voltage and current, and an output for providing a full wave rectified signal. The power factor correction circuit 22 receives the rectified signal and boosts it to a level above the line voltage, which is typically about 1 to 5 times the line voltage, for example. The inverter 26 receives the stepped up signal and provides the start-up voltage and the operating voltage for the gas discharge lamp 50.

In accordance with the present invention, the ballast 10 further includes a controller 30 connected to the power supply 20 for providing the desired operating parameters based upon the type of gas discharge lamp. The desired operating parameters comprises at least one of a start-up voltage, preheat time and a preheat frequency, an operating frequency, a frequency ramping profile which shifts the operating frequency from preheat to ignition to operation, fault detection levels, and minimum and maximum dimming frequency to be used with an external dimming control. By applying the desired operating parameters to the gas discharge lamp 50, the life of the lamp is increased because there is less stress on the electrodes and on the inverter 26.

The controller 30 comprises a memory 32 having a plurality of desired operating parameters stored therein for respective different types of gas discharge lamps. The controller 30 further comprises a sensing circuit 34 for causing the power supply 20 to supply a current to the gas discharge lamp 50 prior to start-up.

The sensing circuit 34 senses a voltage with respect to the gas discharge lamp 50 which is indicative of a type of the gas discharge lamp. A control circuit 36 causes the power supply 20 to provide the desired operating parameters based upon the type of gas discharge lamp. For example, if the sensed voltage is within a lower range of 1 to 2 volts, the gas discharge lamp 50 can be classified as a type A lamp. If the sensed voltage is within a range of 2 to 3 volts, the gas discharge lamp 50 can be classified as a type B lamp. Each lamp type has associated therewith particular operating parameters. If the acquired voltage is very high, the control circuit 36 will determine an open load condition, and a start-up voltage will not be applied to the gas discharge lamp 50.

In one embodiment, the control circuit 36 comprises a microcontroller 37 or microprocessor, and the memory 32 may be embedded therein. Other combinations and variations of the memory 32 and the control circuit 36 for cooperating with the sensing circuit 34 and the power supply 20 are readily acceptably, such as having the memory external the control circuit as illustrated in FIG. 1.

Figure 2:
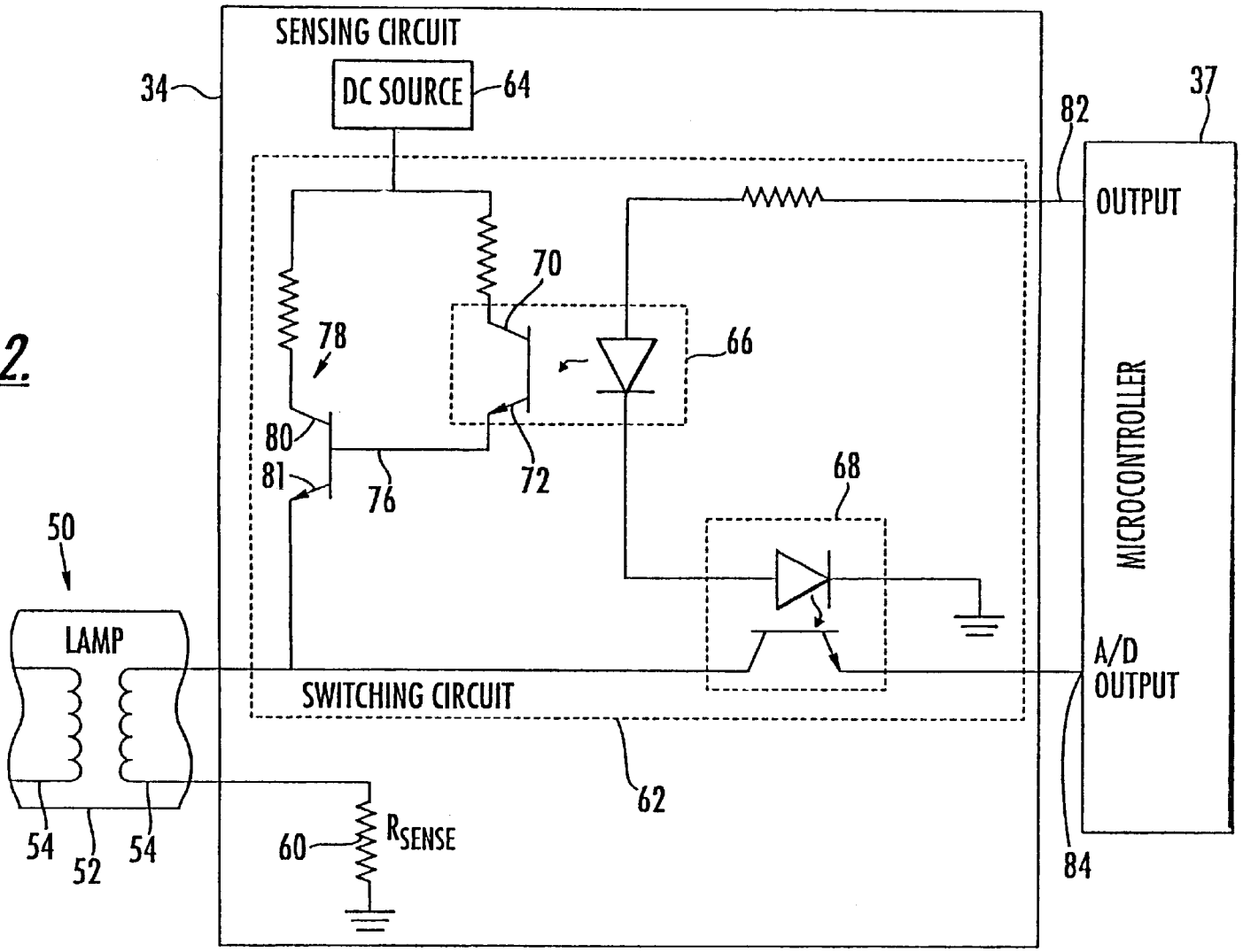
FIG. 2 is a schematic diagram of the controller illustrated in FIG. 1.

As discussed above, the sensing circuit 34 may also be part of the controller 30. In one embodiment, the sensing circuit 34 senses the voltage across one of the electrodes 54 of the gas discharge lamp 50, as best illustrated in FIG. 2. In another embodiment, the sensing circuit 34 senses the voltage across the electrode 54 and across a sense resistor 60 connected between the electrode and ground.

The sensing circuit 34 further includes a switching circuit 62 connected to a DC voltage reference 64, such as 5 volts, for example, and to the electrode 54. The control circuit 36 provides a control signal for operating the switching circuit 62. In the illustrated embodiment, the switching circuit 62 comprises at least one photocoupler, and preferably a pair of photocouplers 66 and 68.

A conducting terminal 70 of photocoupler 66 is connected to the DC voltage reference 64, whereas conducting terminal 72 is connected to the control terminal 76 of a transistor 78. With respect to transistor 78, conducting terminal 80 is connected to the DC voltage reference 64 and conducting terminal 81 is connected to the electrode 54. The second photocoupler 68 is connected to the first photocoupler 66 and to conduction terminal 81 of transistor 78.

The microcontroller 37 provides a control signal via output 82 for switching the two photocouplers 66 and 68 to a conducting state. When the photocouplers 66 and 68 are switched to a conducting state, current flows through the electrode 54 and the sense resistor 60. After the voltage across the electrode 54 has stabilized, an analog/digital input 84 of the microcontroller 37 receives the sensed voltage and converts it to a digital value.

The sensed voltage is compared to known lamp type voltages. For example, if the sensed voltage is within a lower range of 1 to 2 volts, the gas discharge lamp 50 can be classified as a type A lamp. A type A lamp has a particular set of operating parameters, such as those parameters corresponding to operation of a 40 watt lamp. If the sensed voltage is within a range of 2 to 3 volts, the gas discharge lamp 50 can be classified as a type B lamp. A type B lamp has a different particular set of operating parameters, such as those parameters corresponding to operation of a 20 watt lamp. If the acquired voltage is very high, such as near the voltage of the DC source 64, the microcontroller 37 will determine an open load condition, and a start-up voltage will not be applied to the gas discharge lamp 50.

Figure 3A:
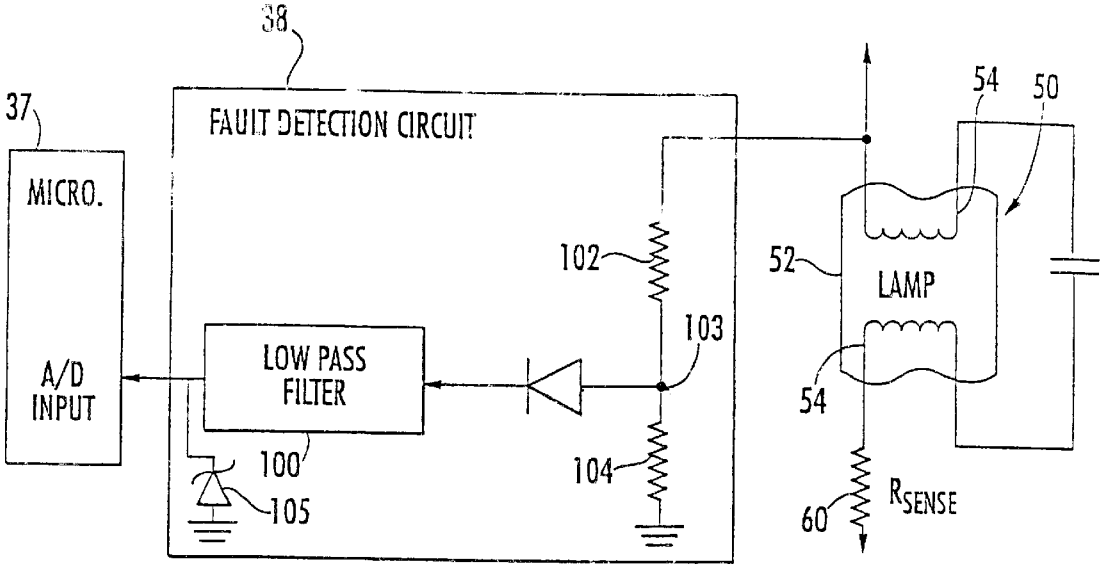
FIG. 3*a* is a schematic diagram of a first embodiment of the fault detection circuit illustrated in FIG. 1.

Based upon the sensed voltage, the lamp type can advantageously be identified and as a result, ballast operating conditions can be defined to fit the particular lamp characteristics. The ballast 10 further includes a fault detection circuit 38 connected between the gas discharge lamp 50 and the microcontroller 37. In one embodiment, the fault detection circuit 38 comprises a resistor divider 102, 104 connected to the electrode 54, and a low pass filter 100 connected between a midpoint 103 of the resistor divider 102, 104 and the microcontroller 37, as best shown in FIG. 3*a*. A Zener diode 105 is connected to the output of the low pass filter 100 for clamping any excess voltage therefrom.

The resistance values of resistors 102 and 104 are selected so that a relatively low voltage is present across resistor 104, i.e., a voltage that will not damage the input of the microcontroller 37 yet is sufficient for monitoring. The microcontroller 37 includes an analog to digital converter for converting the output of the low pass filter 100 to a digital value. This value is compared to other values indicative of various conditions, such as an open load or if the gas discharge lamp 50 has not yet ignited.

The microcontroller 37 operates as a fault counter to count the number of times the ballast 10 has had a fault or has failed to ignite. This microcontroller 37 can use this information to modify the start-up characteristics of the ballast 10 and restart the ballast. This modification may include increasing the preheat time or lower the ignition frequency, for example. If after a predetermined number of retries or faults, the inverter 26 may continue operating at the preheat frequency or shut down altogether.

To reset the ballast 10, an input that detects an open load condition may have to be triggered signifying that the bad gas discharge lamp 50 has been removed, and then reset after a certain time has elapsed. This avoids any inadvertent resets while the gas discharge lamp 50 is taken out. Other approaches of resetting the ballast 10 may be used, such as an input from an external switch or from incoming data.

Figure 3B:
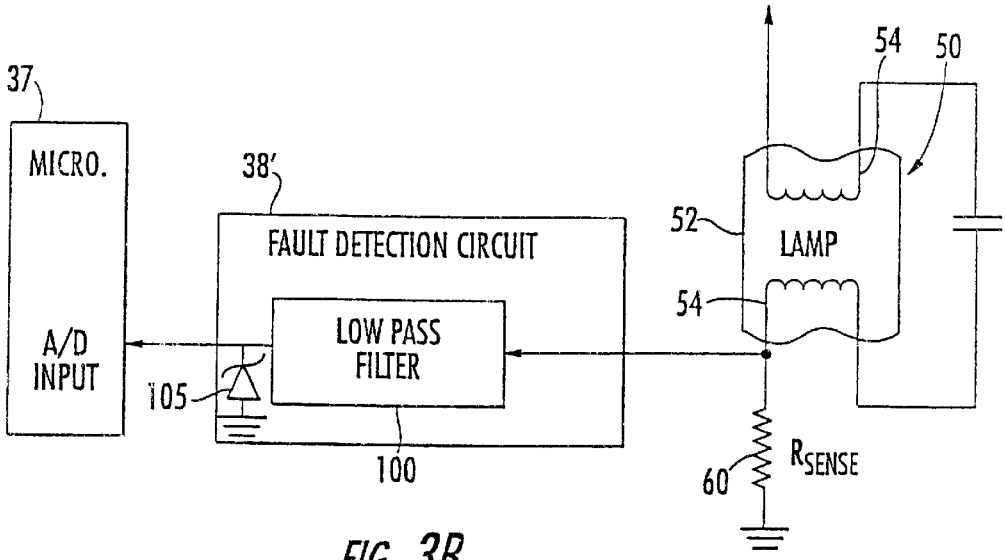
FIG. 3*b* is a schematic diagram of a second embodiment of the fault detection circuit illustrated in FIG. 1.

In another embodiment, the fault detection circuit 38' comprises the low pass filter 100 connected to a midpoint between the sense resistor 60 and the electrode 54, as best shown in FIG. 3*b*. A Zener diode 105 is connected to the output of the low pass filter 100 for clamping any excess voltage therefrom. This particular embodiment of the fault detection circuit 38' also allows the microcontroller 37 to make a determination about the status of the gas discharge lamp 50 by monitoring the voltage across the sense resistor 60.

The information regarding faults and other operating parameters can be stored in the memory 32 which can then be transferred to a fault detection output 39. Fault detection data at the fault detection output 39 may be provided to a master controller or computer via dedicated control wires or by sending the data over the power line or by RF transmission. The fault detection data may include the number and types of faults, current dim level, current number of lamp ignitions, and information regarding the changing of the start-up profile or the number of re-strike attempts.

This later piece of information can keep the lamp starting characteristics from being modified as could be the case if the microcontroller 37 detects a fault and varies the start-up and ignition characteristics needlessly, thus causing extra stress on the gas discharge lamp 50. This collection of information would be helpful for building maintenance personnel, for example.

Figure 4:
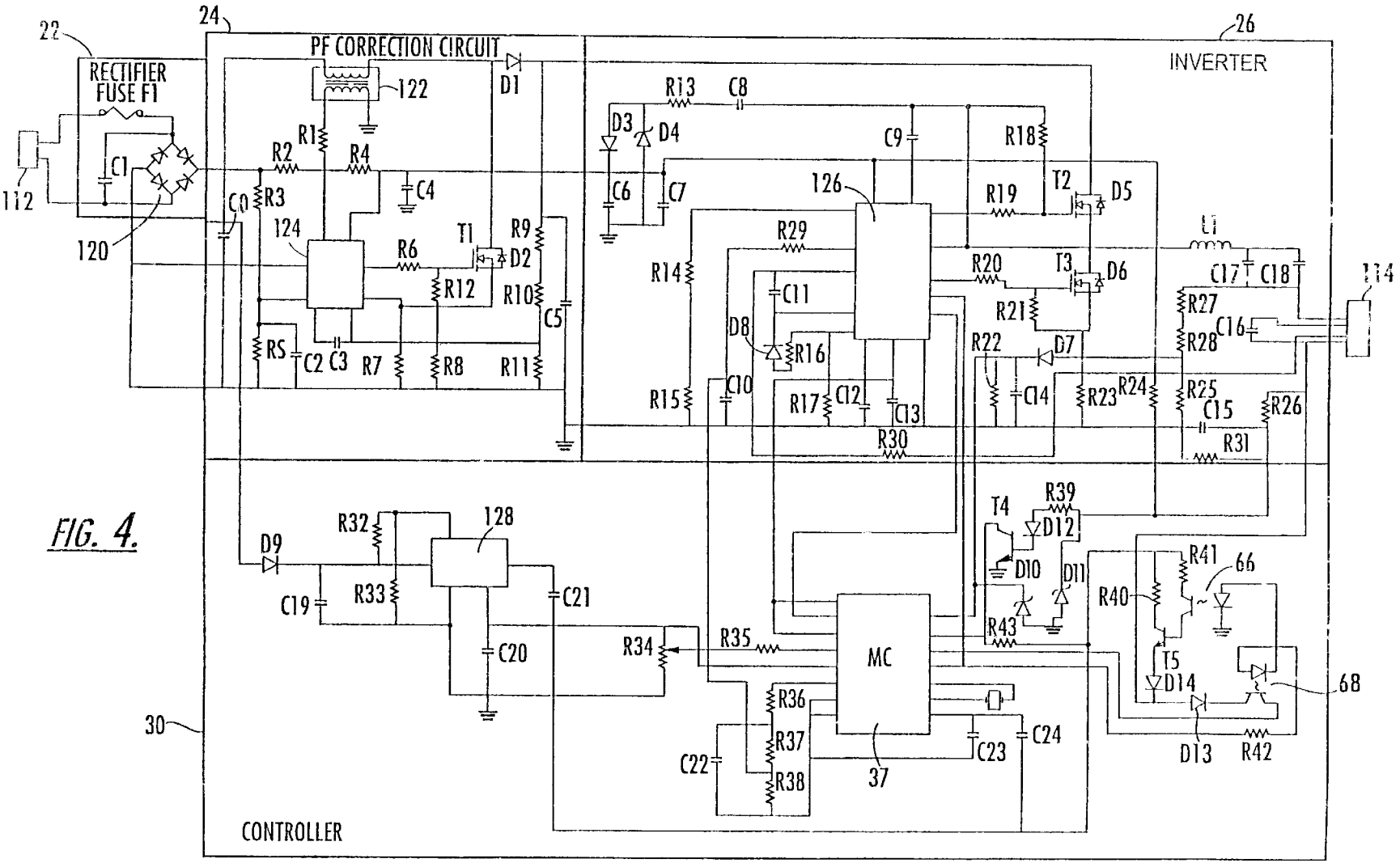
FIG. 4 is a detailed schematic diagram of the ballast illustrated in FIG. 1.

A detailed schematic of the ballast 10 illustrated in FIG. 1 is provided in FIG. 4. An input connecter 112 is connected to the AC source 40. The rectifier 22 converts the alternating voltage and current signal to a full wave rectified signal via a full wave bridge rectifier circuit 120. The rectifier 22 also includes a capacitor C0 and a fuse F1 connected to the full-wave bridge rectifier circuit 120.

The rectified signal from the rectifier 22 is applied to a transformer 122 in the power factor correction circuit 24. The power factor correction circuit 24 includes an integrated circuit 124 and associated circuitry comprising resistors R1–R12, capacitors C1–C5, diodes D1–D2 and transistor T1. The power factor correction circuit 24 boosts the rectified signal to a level that is typically about 1 to 5 times above the line voltage.

The inverter 26 receives the boosted DC signal and applies the start-up voltage based upon a set of operating parameters to a gas discharge lamp 50 that is to be connected to connector 114. The inverter 26 includes an integrated circuit 126 and associated circuitry comprising resistors R13–R31, capacitors C6–C18, diodes D3–D8, inductor L1, and transistors T2–T3.

The controller 30 is connected to the power factor correction circuit 24 and to the inverter 26 for determining the desired operating parameters to be applied to the gas discharge lamp 50. The controller 30 includes a power supply circuit for the microcontroller 37. This power supply circuit includes an integrated circuit 128 and associated circuitry comprising resistors R32–R34, capacitors C19–C21, and diode D9. The control circuit further includes associated circuitry comprising resistors R35–R40, capacitors C22–C24, diodes D10–D12, and transistor T4. The sensing circuit 34 includes photocouplers 66 and 68, resistors R41–R43, diodes D13–D14, and transistor T5.

Another aspect of the invention relates to a method for operating a ballast 10 compatible with different types of gas discharge lamps 50. The method includes storing a plurality of desired operating parameters for respective different types of gas discharge lamps. A current is supplied to the gas discharge lamp 50 via a power supply 20 prior to start-up and a voltage is sensed thereon which is indicative of a type of the gas discharge lamp. The method further includes controlling the power supply 20 to provide the desired operating parameters based upon the type of gas discharge lamp 50.

The controlling includes comparing the sensed voltage to a plurality of lamp type voltages corresponding to respective different types of gas discharge lamps, and selecting the desired operating parameters based upon the sensed voltage corresponding to a stored lamp type voltage. The gas discharge lamp 50 comprises at least one electrode 54, and the sensing comprises sensing the voltage across the electrode.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A ballast compatible with different types of gas discharge lamps and comprising:

a power supply; and a controller connected to said power supply and comprising a memory having a plurality of desired operating parameters stored therein for respective different types of gas discharge lamps, a sensing circuit for causing said power supply to supply a current to the gas discharge lamp prior to start-up and sensing a voltage based thereon indicative of a type of the gas discharge lamp, and a control circuit for causing said power supply to provide the desired operating parameters based upon the type of gas discharge lamp.

2. A ballast according to claim 1, wherein the desired operating parameters comprises at least one of a start-up voltage, preheat time and a preheat frequency, an operating frequency, a frequency ramping profile which shifts the operating frequency from preheat to ignition to operation, fault detection levels, and minimum and maximum dimming frequency to be used with an external dimming control.

3. A ballast according to claim 1, wherein said power supply comprises:

a rectifier having an input for receiving an alternating current (AC) signal and an output for providing a rectified signal; and an inverter having an input for receiving the rectified signal and an output for providing the desired start-up voltage and the desired operating parameters.

4. A ballast apparatus according to claim 3, further comprising a power factor correction circuit connected between said rectifier and said inverter for boosting a level of the rectified signal.

5. A ballast according to claim 1, wherein the gas discharge lamp comprises at least one electrode; and wherein said sensing circuit senses the voltage on the at least one electrode.

6. A ballast according to claim 5, wherein said sensing circuit comprise switching circuit connected to a first voltage reference and to the at least one electrode, and wherein said control circuit provides a control signal for operating said switching circuit so that the current is supplied to the at least one electrode.

7. A ballast according to claim 6, wherein said switching circuit comprises at least one photocoupler.

8. A ballast according to claim 5, wherein said sensing circuit further comprises a sense resistor connected between the at least one electrode and a second voltage reference.

9. A ballast according to claim 1, wherein said control circuit comprises a microcontroller.

10. A ballast according to claim 9, wherein said microcontroller comprises an analog to digital converter for converting the sensed voltage to a digital value.

11. A ballast according to claim 1, wherein said sensing circuit senses the voltage prior to every start-up.

12. A ballast according to claim 1, further comprising a fault detection circuit connected between the gas discharge lamp and said control circuit.

13. A ballast according to claim 12, wherein said control circuit has a fault detection output.

14. A ballast according to claim 12, wherein the gas discharge lamp comprises at least one electrode; and wherein said fault detection circuit comprises:

a resistor divider connected to the at least one electrode; and a low pass filter connected between a midpoint of said resistor divider and said control circuit.

15. A ballast according to claim 12, wherein the gas discharge lamp comprises at least one electrode; and wherein said sensing circuit further comprises a sense resistor connected between the at least one electrode and a voltage reference; and wherein said fault detection circuit comprises a low pass filter connected to a midpoint between said sense resistor and the at least one electrode.

16. A ballast compatible with different types of gas discharge lamps and comprising:

a power supply;

a sensing circuit for causing said power supply to supply a current to the gas discharge lamp prior to start-up and sensing a voltage based thereon indicative of a type of the gas discharge lamp; and a microcontroller connected to said sensing circuit and to said power supply for causing said power supply to provide desired operating parameters by comparing the sensed voltage to a plurality of lamp type voltages corresponding to respective different types of gas discharge lamps.

17. A ballast according to claim 16, wherein said microcontroller comprises a memory connected thereto for storing the plurality of lamp type voltages and the corresponding operating parameters.

18. A ballast according to claim 16, wherein the desired operating parameters comprises at least one of a start-up voltage, preheat time and a preheat frequency, an operating frequency, a frequency ramping profile which shifts the operating frequency from preheat to ignition to operation, fault detection levels, and minimum and maximum dimming frequency to be used with an external dimming control.

19. A ballast according to claim 16, wherein the gas discharge lamp comprises at least one electrode; and wherein said sensing circuit senses the voltage on the at least one electrode.

20. A ballast according to claim 19, wherein said sensing circuit comprises a switching circuit connected to a first voltage reference and to the at least one electrode, and wherein said control circuit provides a control signal for operating said switching circuit so that the current is supplied to the at least one electrode.

21. A ballast according to claim 20, wherein said switching circuit comprises at least one photocoupler.

22. A ballast according to claim 19, wherein said sensing circuit further comprises a sense resistor connected between the at least one electrode and a voltage reference.

23. A ballast according to claim 16, wherein said microcontroller comprises an analog to digital converter for converting the sensed voltage to a digital value.

24. A ballast according to claim 16, wherein said sensing circuit senses the voltage prior to every start-up.

25. A ballast according to claim 16, further comprising a fault detection circuit connected between the gas discharge lamp and said microcontroller.

26. A gas discharge lighting device comprising:

at least one gas discharge lamp comprising a housing, at least one electrode carried by said housing, and a gas contained within said housing and contacting said at least one electrode; and a ballast compatible with different types of gas discharge lamps and being connected to said at least one electrode, said ballast comprising a power supply, and a controller connected to said power supply and comprising a memory having a plurality of desired operating parameters stored therein for respective different types of gas discharge lamps, a sensing circuit for causing said power supply to supply a current to said at least one electrode prior to start-up and sensing a voltage based thereon indicative of a type of the gas discharge lamp, and control circuit for causing said power supply to provide the desired operating parameters based upon the type of gas discharge lamp.

27. A gas discharge lighting device according to claim 26, wherein the desired operating parameters comprises at least one of a start-up voltage, preheat time and a preheat frequency, an operating frequency, a frequency ramping profile which shifts the operating frequency from preheat to ignition to operation, fault detection levels, and minimum and maximum dimming frequency to be used with an external dimming control.

28. A gas discharge lighting device according to claim 26, wherein said sensing circuit senses the voltage on said at least one electrode.

29. A gas discharge lighting device according to claim 28, wherein said sensing circuit comprises a switching circuit connected to a first voltage reference and to said at least one electrode, and wherein said control circuit provides a control signal for operating said switching circuit so that the current is supplied to said at least one electrode.

30. A gas discharge lighting device according to claim 29, wherein said switching circuit comprises at least one photocoupler.

31. A gas discharge lighting device according to claim 29, wherein said sensing circuit further comprises a sense resistor connected between said at least one electrode and a second voltage reference.

32. A gas discharge lighting device according to claim 26, wherein said control circuit comprises a microcontroller.

33. A gas discharge lighting device according to claim 26, wherein said sensing circuit senses the voltage prior to every start-up.

34. A gas discharge lighting device according to claim 26, further comprising a fault detection circuit connected between said at least one electrode and said control circuit.

35. A method for operating a ballast compatible with different types of gas discharge lamps, the method comprising:

storing a plurality of desired operating parameters for respective different types of gas discharge lamps;

supplying a current to the gas discharge lamp via a power supply prior to start-up and sensing a voltage based thereon indicative of a type of the gas discharge lamp; and controlling the power supply to provide the desired operating parameters based upon the type of gas discharge lamp.

36. A method according to claim 35, wherein controlling comprises:

comparing the sensed voltage to a plurality of lamp type voltages corresponding to respective different types of gas discharge lamps; and selecting the desired operating parameters based upon the sensed voltage corresponding to a stored lamp type voltage.

37. A method according to claim 35, wherein the desired operating parameters comprises at least one of a start-up voltage, preheat time and a preheat frequency, an operating frequency, a frequency ramping profile which shifts the operating frequency from preheat to ignition to operation, fault detection levels, and minimum and maximum dimming frequency to be used with an external dimming control.

38. A method according to claim 35, wherein the gas discharge lamp comprises at least one electrode; and wherein sensing the voltage comprises sensing the voltage on the at least one electrode.

39. A method according to claim 35, wherein the gas discharge lamp comprises at least one electrode; and wherein supplying the current comprises operating a switching circuit connected to a first voltage reference and to the at least one electrode.

40. A method according to claim 38, further comprising providing a control signal for operating the switching circuit so that the current is supplied to the at least one electrode.

41. A method according to claim 38, wherein a sense resistor is connected between the at least one electrode and a voltage reference; and wherein sensing the voltage comprises sensing the voltage on the at least one electrode and the sense resistor.

42. A method according to claim 35, wherein the sensing the voltage is performed prior to every start-up.

43. A method according to claim 35, further comprising detecting a fault based upon the sensed voltage.

* * * * *